US009506209B2

(12) United States Patent
Schneider

(10) Patent No.: US 9,506,209 B2
(45) Date of Patent: Nov. 29, 2016

(54) FOLDABLE COLLECTING APPARATUS

(71) Applicant: K.F. Innovative Trade LTD, Raanana (IL)

(72) Inventor: Oran Schneider, Bar Yohai (IL)

( * ) Notice: Subject to any disclaimer, the term of this patent is extended or adjusted under 35 U.S.C. 154(b) by 0 days.

(21) Appl. No.: 15/027,849

(22) PCT Filed: Oct. 19, 2014

(86) PCT No.: PCT/IL2014/000053
§ 371 (c)(1),
(2) Date: Apr. 7, 2016

(87) PCT Pub. No.: WO2015/056254
PCT Pub. Date: Apr. 23, 2015

(65) Prior Publication Data

US 2016/0244924 A1 Aug. 25, 2016

(30) Foreign Application Priority Data

Oct. 17, 2013 (IL) ..... 228958

(51) Int. Cl.
*A01K 29/00* (2006.01)
*E01H 1/12* (2006.01)

(52) U.S. Cl.
CPC ..... *E01H 1/1206* (2013.01); *E01H 2001/126* (2013.01)

(58) Field of Classification Search
CPC ..... E01H 1/1206
USPC ..... 294/1.3, 1.4, 1.5, 176; 15/157.1, 157.6; 229/117.01, 117.03, 117.09, 117.12
See application file for complete search history.

(56) References Cited

U.S. PATENT DOCUMENTS 3,685,088 A * 8/1972 Doherty ..... E01H 1/1206 15/257.6
4,186,955 A * 2/1980 Campbell ..... E01H 1/1206 15/104.8
4,200,319 A * 4/1980 Cooper ..... E01H 1/1206 294/1.4
4,247,139 A * 1/1981 Grieb ..... E01H 1/1206 294/1.4
4,402,452 A * 9/1983 Kupersmit ..... B65D 5/36 229/117.01
4,747,633 A 5/1988 Stacy
4,974,893 A * 12/1990 Grahn ..... E01H 1/1206 15/104.8
5,039,148 A * 8/1991 Brautovich ..... E01H 1/1206 294/1.3
5,441,017 A 8/1995 Lindsay
5,725,268 A * 3/1998 Besasie ..... E01H 1/1206 294/1.3
5,964,488 A * 10/1999 Bedel ..... E01H 1/1206 15/257.6

(Continued)

FOREIGN PATENT DOCUMENTS

FR 2781827 * 2/2000 ..... E01H 1/12

OTHER PUBLICATIONS

The Israeli Patent Office (ILPO) sent during the examination of the Israeli parent patent application No. 228956 the following Office Actions: An Office Action dated May 27, 2014; (This original document and its translation into English are enclosed).

*Primary Examiner* — Paul T Chin

(57) ABSTRACT

A foldable collecting utensil is provided, which comprises two interconnected sub-compartments which are closable enclose collected material. The utensil is collapsible to a flat storing state and may be transferred into an operable enclosing state by pulling lateral tabs Tour pairs of intersecting folding lines define the allowable folding operations for changing the state of the utensil.

1 Claim, 15 Drawing Sheets

(56) References Cited

U.S. PATENT DOCUMENTS 8,708,381 B2 * 4/2014 Chongtoua ..... A01K 1/0125 15/257.6

2003/0041809 A1 * 3/2003 Tsigrik ..... E01H 1/1206 119/161

2010/0045056 A1 * 2/2010 Greenhut ..... E01H 1/1206 294/1.3

* cited by examiner

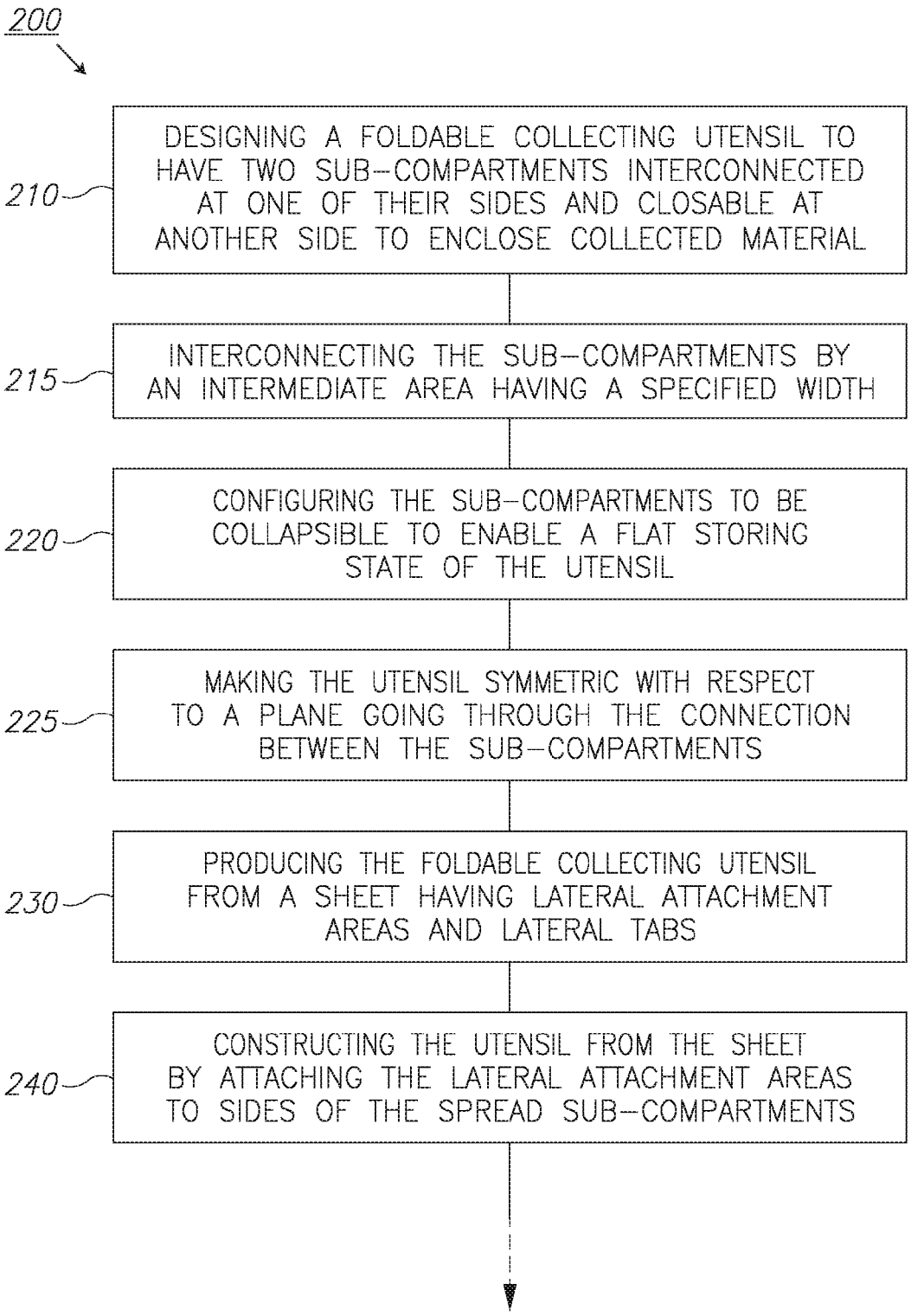
Figure 9 (cont. 1)

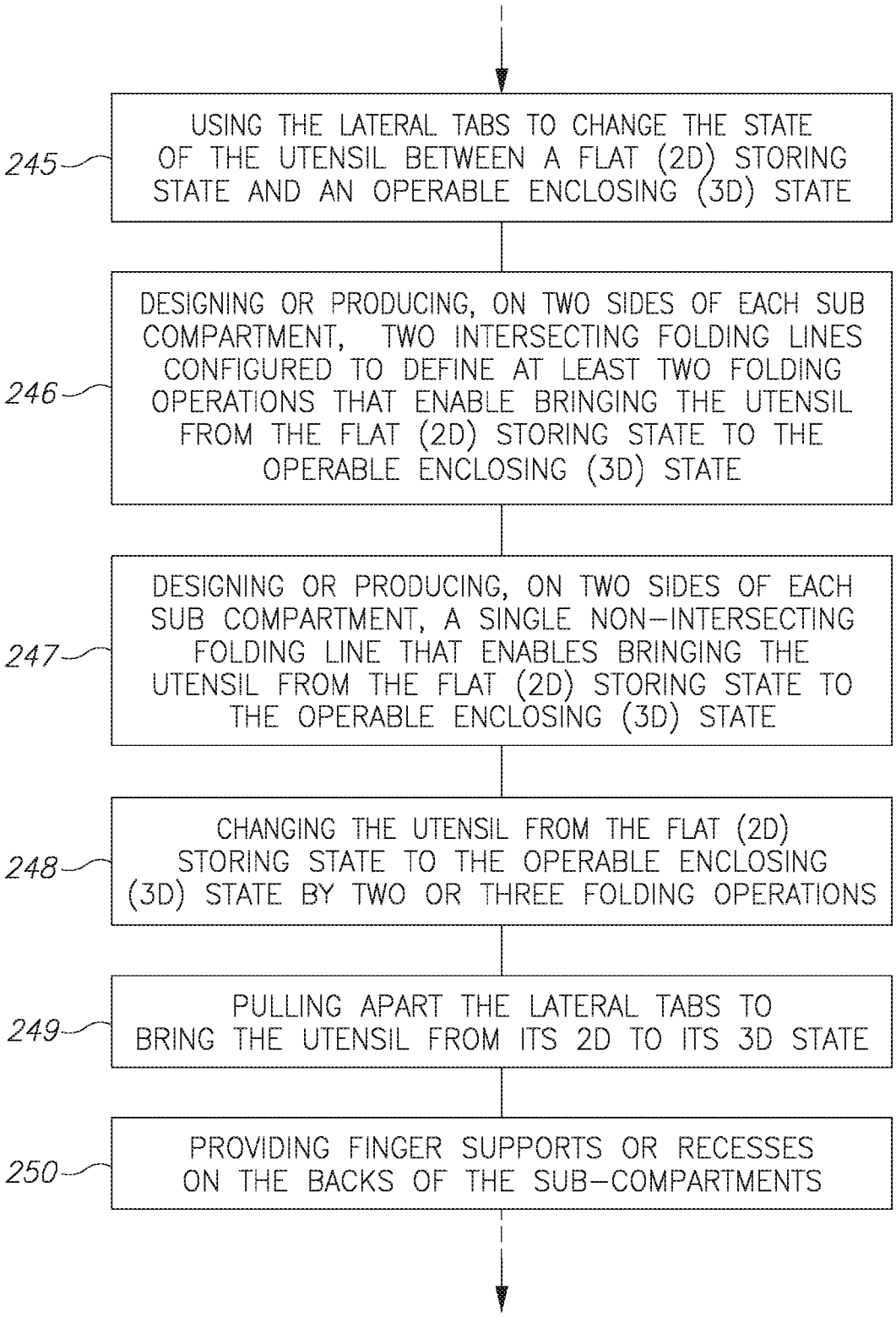
Figure 9 (cont. 2)

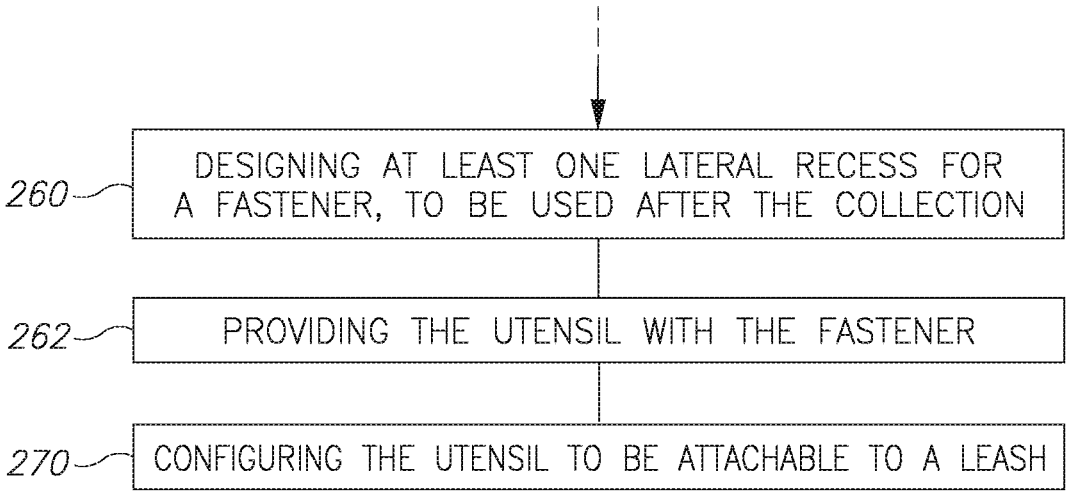
Figure 9 (cont. 3)

FOLDABLE COLLECTING APPARATUS

RELATED APPLICATIONS

This application is a National Phase of PCT Patent Application No. PCT/IL2014/000053 having International filing date of 19 Oct. 2014, which claims the benefit of priority of IL Patent Application No. 228958 flied on 17 Oct. 2013. The contents of the above applications are all incorporated by reference as if fully set forth herein in their entirety.

BACKGROUND OF THE INVENTION

The present invention relates to the field of collection apparatus, and more particularly, to foldable apparatus.

DISCUSSION OF RELATED ART

Many people are confronted daily with the need to collect material they prefer not to touch, such as pet feces. Use of plastic bags is common but environmentally deficient while dedicated apparatus are often cumbersome, impractical or expensive.

U.S. Pat. No. 4,747,633 discloses a disposable scoop and container having a pair of foldable hinged panels, each of the panels having foldable side panels and a front panel, which may be folded into compact flat form and may be unfolded to form a scoop cavity, wherein one of the scoops may be recessible into the other scoop, and locking tabs for holding one scoop in recessed locked position within the other scoop.

European Patent Document No. 1,283,305 discloses a feces picking up device composed of a flat element which after folding is in the shape of a box constituted by two containers of equal dimensions which are articulated by two U-shaped crenellated handles. To form the volume, folds are made along the grooves and the handles slid into slits. The volume is fastened by folding down triangular tabs extended by tongues.

SUMMARY OF THE INVENTION

One aspect of the present invention provides a foldable collecting apparatus comprising two sub-compartments interconnected at one of their sides and closable at another side to enclose collected material, the sub-compartments configured to be collapsible to enable a flat storing state of the apparatus; wherein the foldable collecting apparatus is constructed from a sheet having lateral attachment areas and lateral tabs, by attaching the lateral attachment areas to sides of the spread sub-compartments, and wherein the lateral tabs are arranged to allow changing a state of the apparatus between the flat (2D) storing slate and an operable enclosing (3D) state.

These, additional, and/or other aspects and/or advantages of the present invention are set forth in the detailed description which follows; possibly inferable from the detailed description; and/or learnable by practice of the present invention. The foldable collecting apparatus (100) will be named in the application also as a foldable collecting utensil.

BRIEF DESCRIPTION OF THE DRAWINGS

For a better understanding of embodiments of the invention and to show how the same may be carried into effect, reference will now be made, purely by way of example, to the accompanying drawings in which like numerals designate corresponding elements or sections throughout. In the accompanying drawings:

FIG. 9 is a high level flowchart illustrating a method of designing the foldable collecting apparatus, according to some embodiments of the invention.

DETAILED DESCRIPTION OF THE INVENTION

Figure 1A:
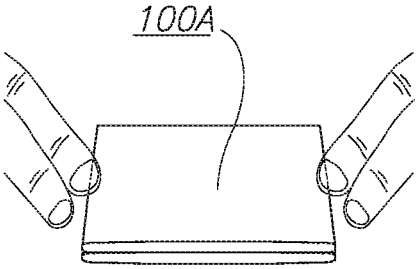
FIGS. 1A-1G are traced photos illustrating the folding of the foldable collecting apparatus into and between its stales, according to some embodiments of the invention.

Prior to the detailed description being set forth, it may be helpful to set forth definitions of certain terms that will be used hereinafter. The terms "flat state" or "two dimensional (2D) state" as used in this application refer loosely to a more or less planar configuration of the described apparatus (state 100A), in which it is folded flat and extends mainly in two dimensions (in the physical, not geometrical sense).

The terms "enclosing state", "operable stale", "collection state" or "three dimensional (3D) state" as used in this application refer loosely to a voluminous configuration of the described apparatus (state 100B), in which it is folded to a volume filling state in which it can be used to collect and to enclose collected material, and in which the apparatus extends in three dimensions and has a significant volume.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Before at least one embodiment of the invention is explained in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

A foldable collecting apparatus is provided, which comprises two interconnected sub-compartments which are closable enclose collected material. The apparatus is collapsible to a flat storing stale and may be transferred into an operable enclosing slate by pulling lateral tabs. Four pairs of intersecting folding lines may define at least some of the allowable folding operations for changing the state of the apparatus between the flat (2Dj state and the operable (3D) slate and back.

FIGS. 1A-1G are traced photos illustrating the folding of the foldable collecting apparatus into and between its states, according to some embodiments of the invention.

FIGS. 3A, 4, 5, 6 and 7 are schematic illustrations of foldable collecting apparatus 100 as spread sheets 100, according to some embodiments of the invention. FIGS. 3A, 4, 5, 6 and 7 illustrate foldable collecting apparatus 100 in spread forms, from which apparatus 100 may be produced, as explained below.

Foldable collecting utensil 100 may comprise two sub-compartments 140 interconnected at one of their sides 141 and closable at another side 142 to enclose collected material such as animal droppings. Sub-compartments 140 are configured to be collapsible to enable a flat storing state 100A of utensil 100.

Figure 1B:
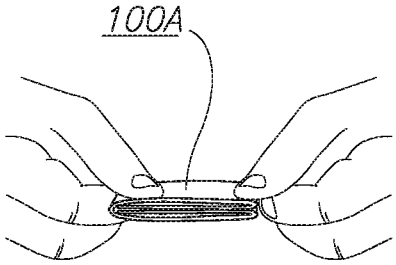
Figure 1C:
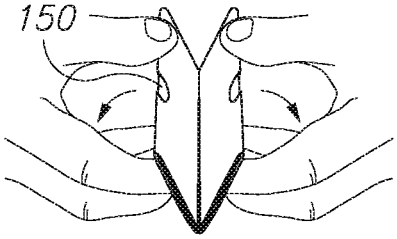
Figure 1D:
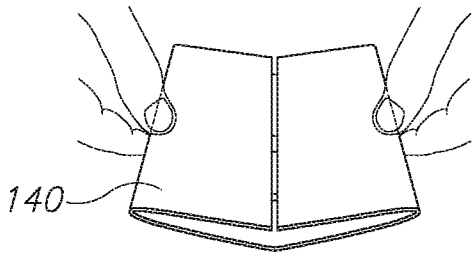
Figure 1E:
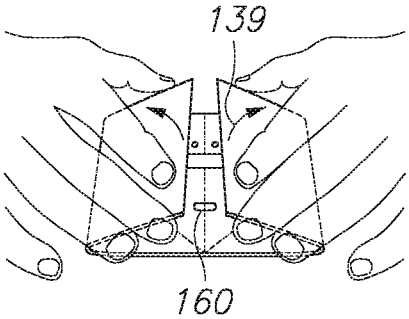
Figure 1F:
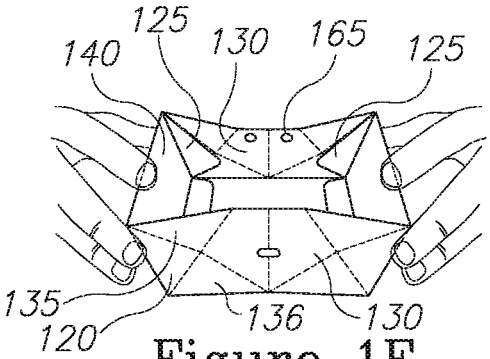
Figure 1G:
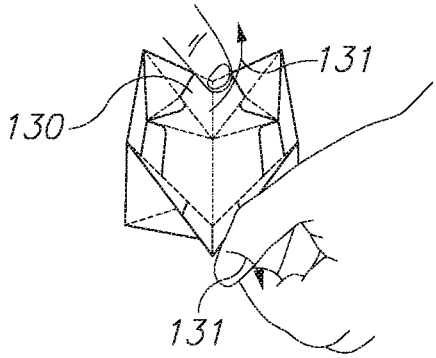
Figure 2A:
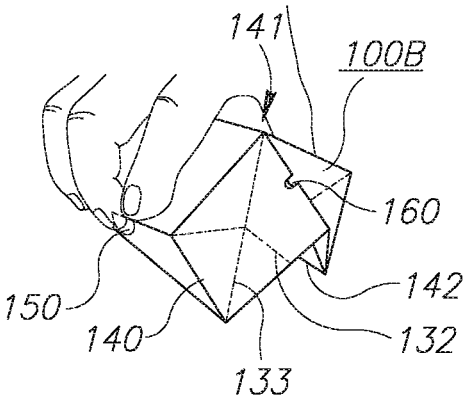
FIGS. 2A and 2B are traced photos illustrating the operation of the apparatus in its operable enclosing (3D) stale, according to some embodiments of the invention.
Figure 2B:
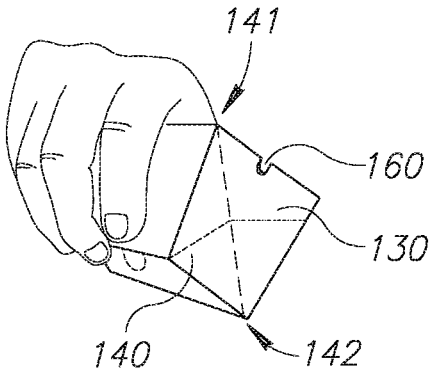

FIGS. 1A and 1B illustrate utensil 100 in flat (2D) storing state 100A, according to some embodiments of the invention. FIG. 1A is a top view while FIG. 1B is a side view illustrating the flatness, or two-dimensionality of utensil 100 in flat (2D) storing stale 100A. FIG. 1C-1G illustrate the transition of utensil 100 from flat (2D) storing state 100A to operable enclosing (3D) state 100B, according to some embodiments of the invention. FIGS. 2A and 2B are traced photos illustrating the operation of utensil 100 in its operable enclosing (3D) state 100B, according to some embodiments of the invention.

Figure 3A:
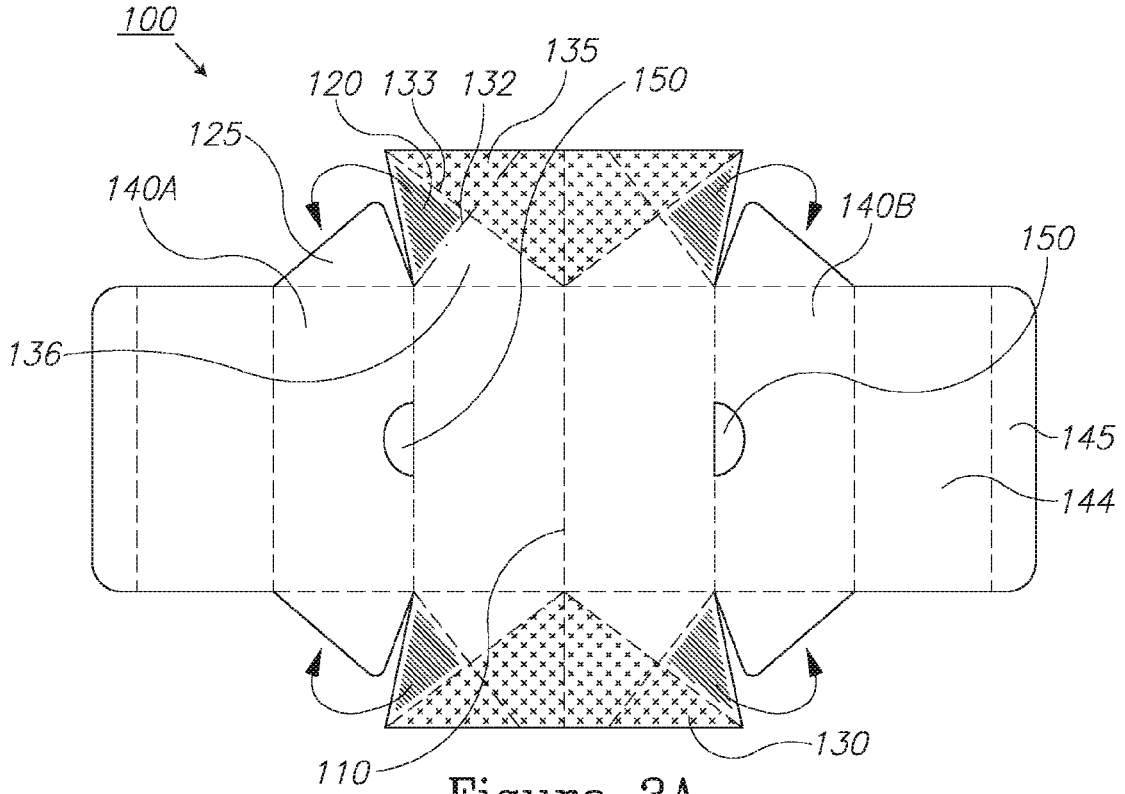
FIGS. 3A, 4, 5, 6 and 7 are schematic illustrations of foldable collecting apparatus as spread sheets, according to some embodiments of the invention.

Foldable collecting utensil 100 may be constructed from a sheet 100 as illustrated e g. in FIGS. 3A, 4, 5, 6 and 7. Foldable collecting utensil 100 may comprise lateral attachment areas 120 which may be attached to sides 125 of the spread sub-compartments 140A, 140B to prepare utensil 100 for use. Sides 125 may be lateral flap, as illustrated e.g. in FIGS. 3A, 4 and 7 or may be parts of sub-compartments 140A, 140B as illustrated e.g. in FIGS. 5 and 6. Lateral attachment areas 120 may be attached on either side of sides 125, FIG. 3A illustrates a non-limiting example of attaching lateral attachment areas 120 to the back of sides 125.

Foldable collecting utensil 100 further comprises lateral tabs 130 which are arranged to allow changing a state (131) of utensil 100 between flat (2D) storing state 100A and operable enclosing (3D) state 100B (and back, inverse to 139, if necessary). FIGS. 1F and 1G illustrate the transition between states 100A and 100B by pulling lateral tabs 130 sideways (131), in a lateral direction with respect to the direction of operation of utensil 100 when collecting material (compare to FIGS. 2A and 2B). In certain embodiments, utensil 100 may be configured to allow bringing utensil 100 from flat (2D) storing state 100A to operable enclosing (3D) state 100B by two or three folding operations, at least one of which involving pulling apart lateral tabs 130 (FIGS. 1C-1G).

As is clear from the explanation above and from the accompanying drawings, for example FIG. 3A, the utensil 100 has two lateral tabs 130, one on either side. The edges of each lateral tab are as follows: one edge is in fact the edge of the utensil itself, and the other is the border with the lateral attachment area (120) and the lateral recess area 160. Pulling lateral tabs 130 sideways (arrows 131 in FIG. 1G) may lock utensil 100 in its 3D collection state 100B, such locking may be releasable or non-releasable. A folding opposite to arrows 139 in FIG. 1E may indicate folding utensil 100 back into its flat (2D) state 100A.

Figure 3B:
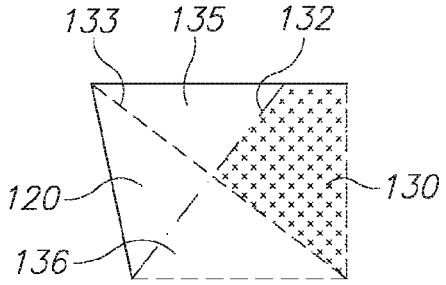
FIGS. 3B-3D are schematic illustrations of the folding principle of foldable collecting apparatus, according to some embodiments of the invention.
Figure 3C:
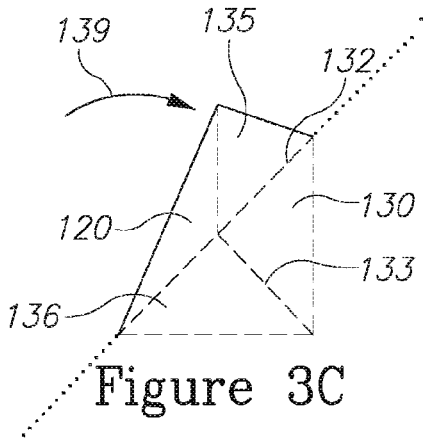
Figure 3D:
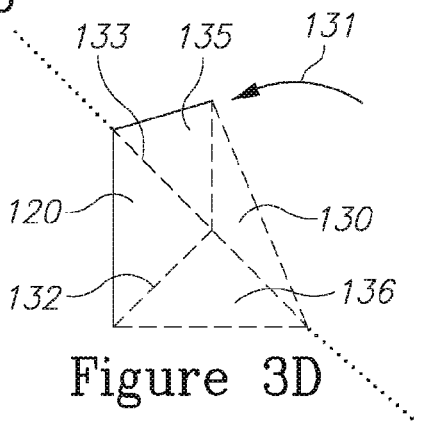
Figure 4:
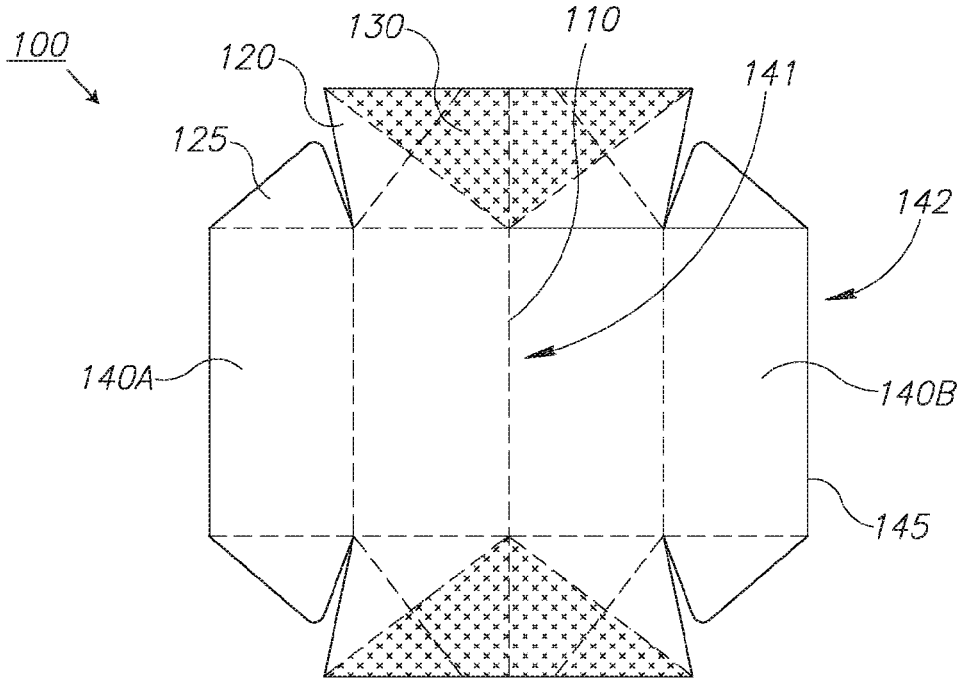
Figure 5:
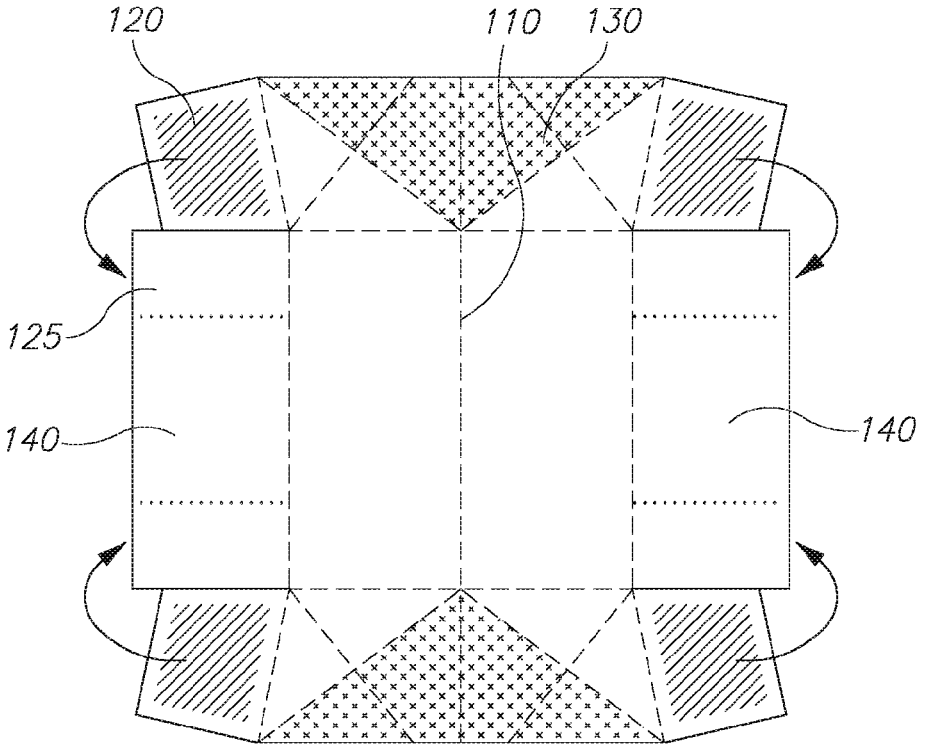

FIGS. 3B-3D are schematic illustrations of the folding principle of foldable collecting utensil 100, according to some embodiments of the invention. FIGS. 3B-3D exemplify the folding principle on the basis of FIG. 3A in a non-limiting manner which is applicable to any embodiments of the invention. The folding principle involves designing and/or producing two intersecting folding lines 132, 133 which define the possible folding operations of utensil 100. In the illustrated example, folding line 132 allows folding utensil 100 into and from flat (2D) state 100A in the direction of arrow 139 (FIG. 3C, and compare FIG. 1E). In the illustrated example, folding line 133 allows folding utensil 100 into and from operable (3D) state 100B in the direction of arrow 131 (FIG. 3D. and compare FIG. 1G). While both cases area 136 is stationary, area 135 is folded along edges 132 and 133 respectively (see FIGS. 3C and 3D with respect to FIG. 3B, respectively). Intersecting folding lines 132, 133, which are configured to define at least two of the folding operations (139, 131 respectively) may be designed and/or produced on two sides of each sub compartment 140.

As is clear from the explanation offered in this application and from the accompanying drawings, the intersecting folding lines 132 and 133 enable folding and re-folding of the utensil 100 from a flat state (2D) to an operable state (3D). After opening the utensil 100 to the operable state (3D), each lateral tab (130) is folded and thus protrudes from the side of the utensil 100. In the operable state (3D), folding line 133 prevents the utensil 100 from collapsing. Folding line 133 will hereinafter be referred to also as "collapse-preventing line" 133. As opposed to utensil 100, subject of the present invention, the utensil described in U.S. Pat. No. 4,747,633 (patent 633) does not have lateral tabs and does not have collapse-preventing lines. As a result, after the utensil of patent 633 is opened to the operable state (3D), the sub-compartments collapse along the folding line—the line that is equivalent to the folding line 132 of the present invention—when pressure is applied to the utensil. In utensil 100 subject of the present invention, the lateral tabs (130) protrude in the open, operable state (3D) and 'lock' and prevent line 132 from folding and thus prevent the collapse of one sub-compartment 140 on the other one when pressure is applied to the utensil 100 when in use. In other words, the folding line 132 cannot be folded in open operable state (3D).

Advantageously, and in contrast to prior art containers and devices, utensil 100 is much more practical, easy to use, easy to produce and cheap. In particular, its flat storing state allows the user to simple insert folded utensil 100 into the pocket and transform utensil 100 into its operable collecting state 100B only if and when it is needed. Prior art documents such as U.S. Pat. No. 4,747,633 or European Patent Document No 1,283,305 are cumbersome and impractical to use. The later documents for example, although it is produced by folding a patterned sheet, lacks lateral tabs 130 which enable the user to change the utensil's form from flat state 100A to operable state 100B and hence EP1,283,305's device does not have flat folded state 100A and is less practical than utensil 100 described herein. In particular, these prior art documents lack the folding mechanism of intersecting folding lines 132, 133 which determine the folding onto alternative flat (2D) state 100A and operative (3D) state 100B.

Figure 6:
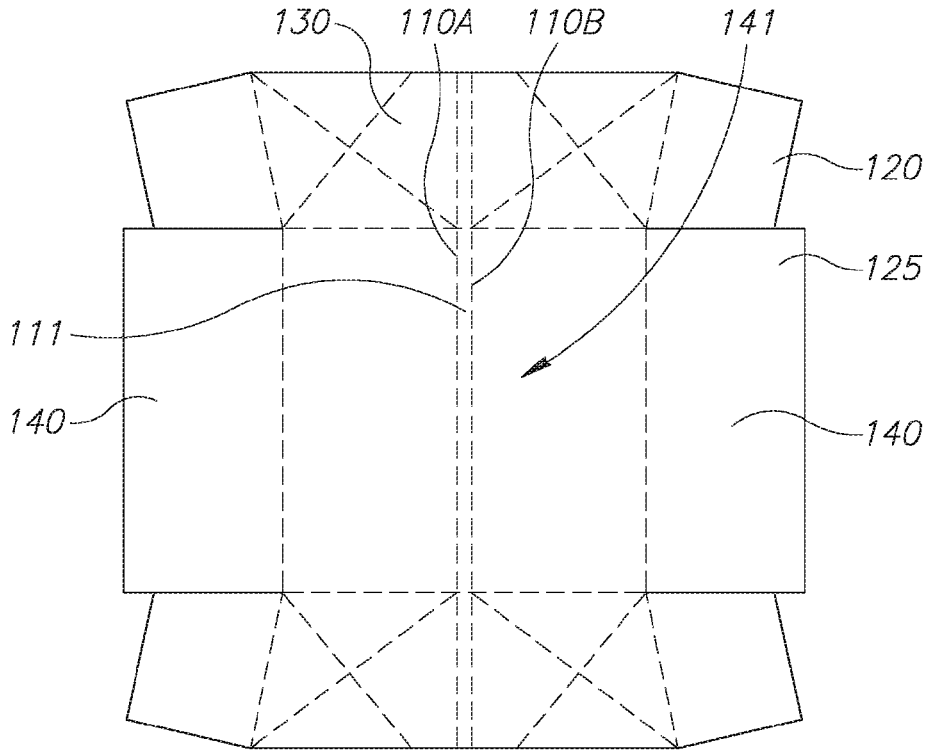
Figure 7:
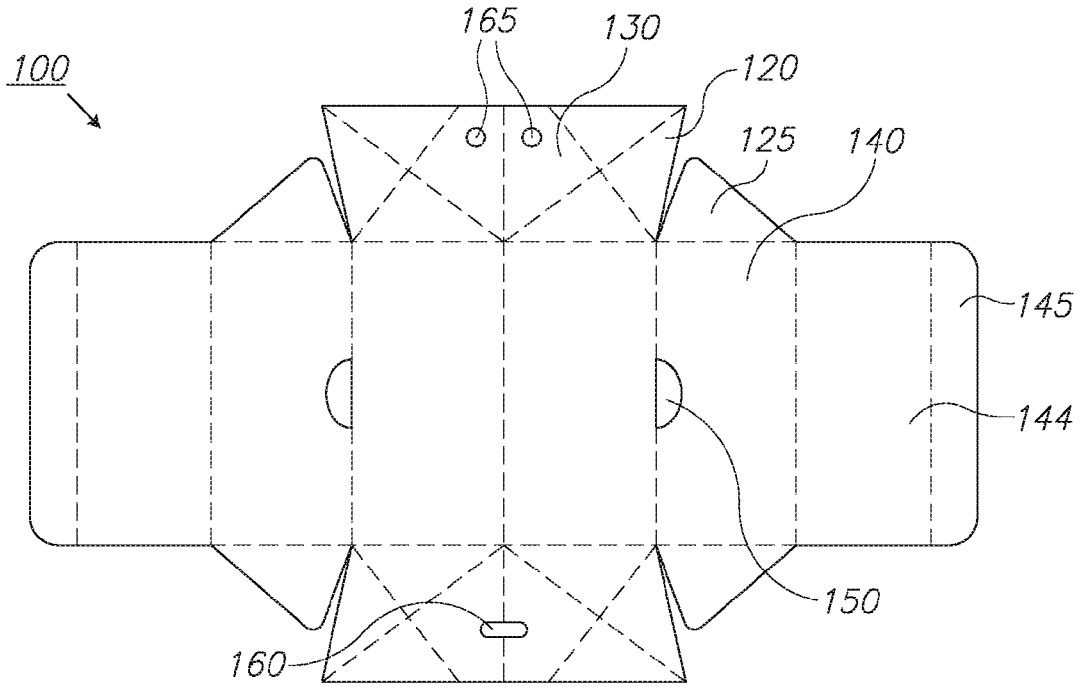

In certain embodiments, utensil 100 may be symmetric with respect to a plane going through connecting side 141 (connecting sub-compartments 140A, 140B and bridging between lateral tabs 130). Connecting side 141 may be a line 110, as illustrated e.g. in FIGS. 3A, 4, 5 and 7 or may be an intermediate area 111 having a specified width, e.g. defined by two lines 110A, 110B, as illustrated in FIG. 6.

In certain embodiments, sub-compartments 140A, 140B of utensil 100 may comprise supportive walls 144 configured to strengthen utensil 100, increase and/or determine its volume, support edges 145 of sub compartments and enable introducing lateral recesses 150 without compromising the sealability of utensil 100. Edge 145 is configured to seal sub compartments 140 of utensil 100 and may be further configured to make the collection of material easier.

Edge 145 may be shaped e.g. as a flat edge (e.g., as in FIGS. 3A and 7) but may also be toothed or formed to assist collection and retention of the collected material. In certain embodiments, edges 145 of sub-compartments 140A, 140B may be attachable to each other (e.g. by an adhesive, such as one covered by a removable strap) to retain the collected material within utensil 100. Edge 145 may be configured to seal utensil 100 in collection state 100B, to hold the collected material (e.g. feces) until disposal. In certain embodiments, foldable collecting utensil 100 may further comprise finger supports or recesses 150 on one or both sub-compartments 140A, 140B (see e.g., FIGS. 1E, 2A, 2B, 3A, 7) to allow comfortable holding and manipulation of utensil 100. Finger supports or recesses 150 are separated from the inner volume of utensil, e.g. by walls 144.

In certain embodiments, foldable collecting utensil 100 may further comprise at least one lateral recess 160 for engaging a fastener (e.g., an elastic band or strap, not shown), to be used after the collection and maintain utensil 100 closed (as in FIG. 2B). In certain embodiments, foldable collecting utensil 100 may be provided as part of a kit, including the fastener and possibly several utensils 100. In the kit, utensil 100 may be provided in its flat storing state 100A, ready to be used.

In certain embodiments, utensil 100 may be configured to be attachable to a leash (not shown), e.g. by a hanger attached to utensil 100 through holes 165, by a loop, a strap or a thread (not shown) etc. The kit may further comprise attachment means for connecting utensil 100 in either states 100A, 100B (e.g. in flat state 100A before use and in collection state 100B after use) to the leash, a bell, a pocket, etc.

In certain embodiments, foldable collecting utensil 100 may be produced from paper, cardboard or plastic sheets by different methods such as cutting or molding. The folding lines may be partially cut into the sheet (e.g. when the sheets are produced by cutting) or be thinner lines in the sheet (e.g. when the sheets are produced by molding). Foldable collecting utensil 100 may be disposable, in which case it may be produced from recyclable and/or recycled material such as paper or cardboard, or may be made of biodegradable material. Foldable collecting utensil 100 may be configured to be producible by package folding machines, and may be produced in different sizes and forms. Additionally, utensil 100 may comprise printed texts, logos, advertisements etc.

Advantageously, recyclable or biodegradable utensils may spare huge amounts of plastic bags used currently to collect animal droppings and excrements such as dog feces.

Lateral attachment areas 120 and/or sides 125 may be covered with glue and assembled before delivery to the user or may be arranged to be assembled by the user. In case lateral attachment areas 120 are attached to sides 125 during production, utensil 100 may be delivered in flat folded state 100A, and remain in this state until use. The user may easily transform utensil 100 into operable state 100B by unfolding sub compartments 140 and pulling lateral tabs 130 to lock utensil 100 into operable (3D) state I00B (FIGS. 1C-1G). Lateral tabs 130 may be arranged to allow folding back utensil 100 from operable stale 100B to flat state 100A in case utensil 100 was not used. For example, lateral labs 130 may be arranged to allow folding them back, as from FIG. 1G back to FIG. 1C.

FIGS. 8A-8E are schematic illustrations of a foldable collecting utensil and its folding principle, according to some embodiments of the invention. FIGS. 8A-8E illustrate embodiments in which folding lines 132, 133 do not intersect.

Figure 8A:
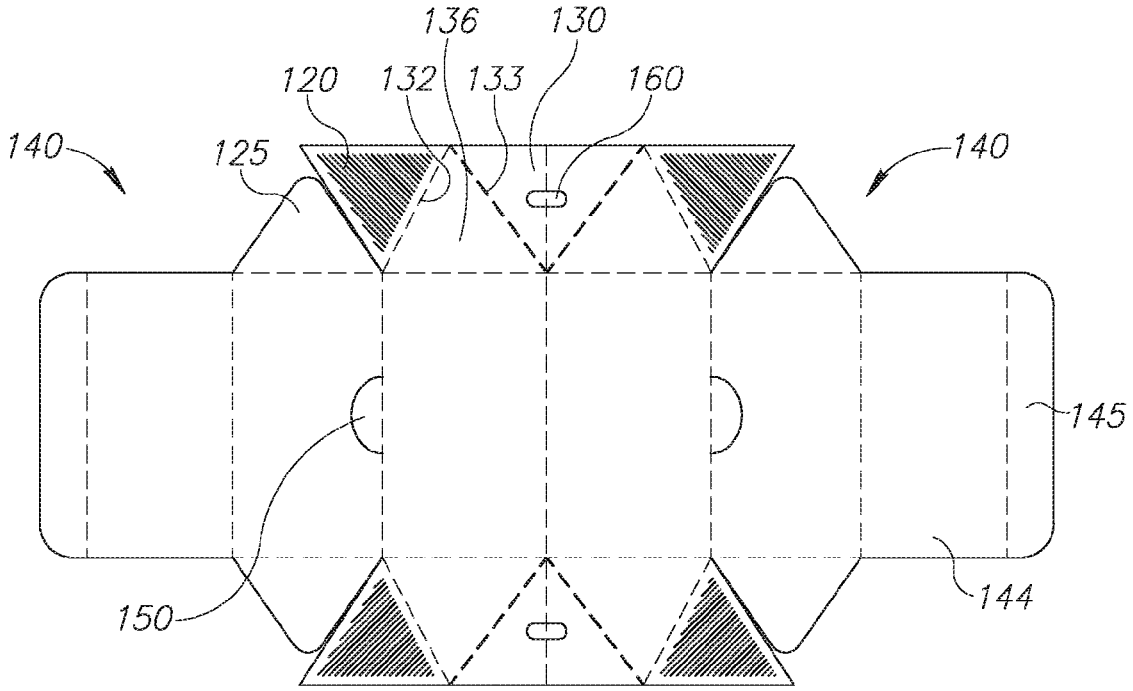
FIGS. 8A-8E are schematic illustrations of a foldable collecting apparatus and its folding principle, according to some embodiments of the invention.
Figure 8B:
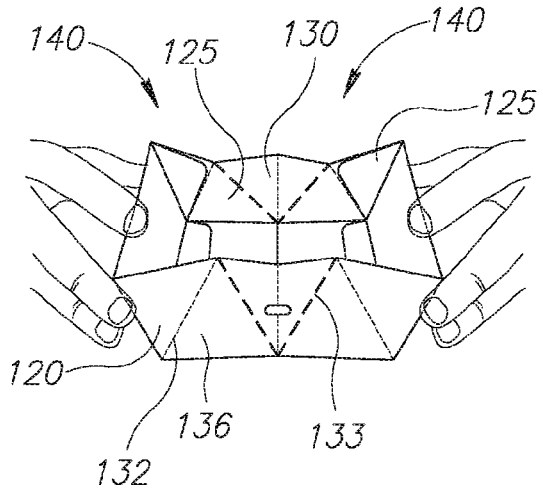
Figure 8C:
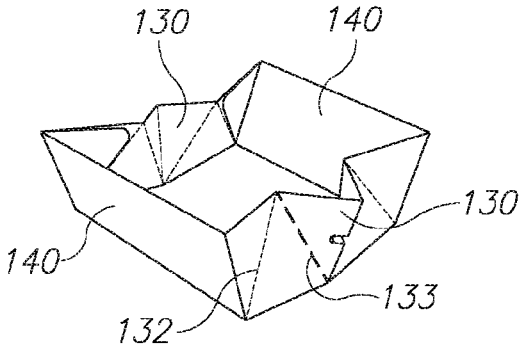
Figure 8D:
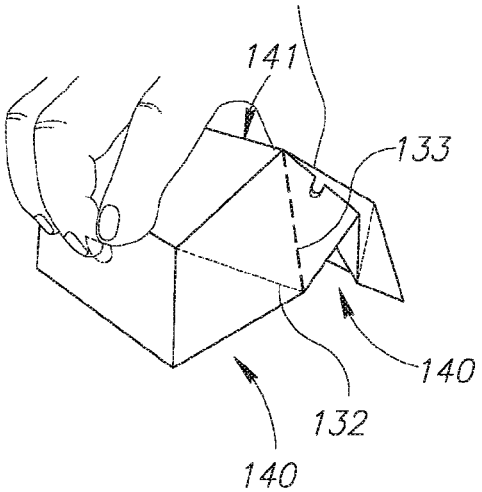
Figure 8E:
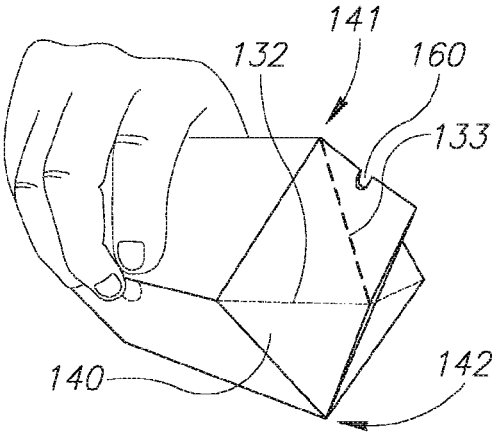

FIG. 8A for example is a spread sheet representation of foldable collecting utensil 100 comprising on two sides of each sub compartment 140, a single non-intersecting folding line 133 that defines lateral tabs 130 and enables bringing utensil 100 from flat (2D) storing state 100A to operable enclosing (3D) state 100B. FIGS. 8B-8E (paralleling FIGS. 1F, 1G, 2A, 2B respectively) illustrate pulling lateral labs 130 defined by folding line 133 to change the state of utensil 100 (FIGS. 8B, 8C) and collecting material with utensil 100 at enclosing (3D) state 100B (FIGS. 8D, 8E). The configuration of single non-intersecting folding line 133 docs not provide the locking of utensil 100 in state 100B as is the case with intersecting folding lines 132, 133 (see FIGS. 3B-3D) yet does enable the change of utensil state.

FIG. 9 is a high level flowchart illustrating a method 200 of designing the foldable collecting utensil, according to some embodiments of the invention.

Method 200 may comprise any of the following stages: designing a foldable collecting utensil to have two sub-compartments interconnected at one of their sides and closable at another side to enclose collected material (stage 210), configuring the sub-compartments to be collapsible to enable a flat storing state of the utensil (stage 220) and to have lateral tabs configured to allow changing the state of the utensil between the fiat (2D) storing state and an operable enclosing (3D) state by using, e.g., pulling apart, the lateral tabs (stages 245, 249). Method 200 may further comprise using the utensil, and during its use, changing the utensil from the fiat (2D) storing state to the operable enclosing (3D) state by two or three folding operations (stage 248).

Method 200 may further comprise designing or producing, on two sides of each sub compartment, two intersecting folding lines configured to define at least two folding operations that enable bringing the utensil from the flat (2D) storing state to the operable enclosing (3D) state (stage 246). In certain embodiments, method 200 may further comprise designing or producing, on two sides of each sub compartment, a single non-intersecting folding line that enables bringing the utensil from the flat (2D) storing state to the operable enclosing (3D) state (stage 247).

Method 200 may further comprise interconnecting the sub-compartments by an intermediate area having a specified width (stage 215). In certain embodiments, method 200 may further comprise making the utensil symmetric with respect to a plane going through the connection between the sub-compartments (stage 225).

In certain embodiments, method 200 may further comprise producing the foldable collecting utensil from a sheet having lateral attachment areas (stage 230) and constructing the utensil from the sheet by attaching the lateral attachment areas to sides of the spread sub-compartments (stage 240).

In certain embodiments, method 200 may further comprise any of the following stages: providing finger supports or recesses on the sub-compartments (stage 240); designing at least one lateral recess for a fastener, to be used after the collection (stage 260); and configuring the utensil to be attachable to a leash (stage 270). In certain embodiments, method 200 may comprise providing one or more utensils together with one or more fasteners for sealing or ensuring the closure of the utensils (stage 262), e.g. as a kit.

In the above description, an embodiment is an example or implementation of the invention. The various appearances of "one embodiment", "an embodiment", "certain embodiments" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Certain embodiments of the invention may include features from different embodiments disclosed above, and certain embodiments may incorporate elements from other embodiments disclosed above.

The disclosure of elements of the invention in the context of a specific embodiment is not to be taken as limiting their used in the specific embodiment alone.

Furthermore, it is to be understood that the invention can be carried out or practiced in various ways and that the invention can be implemented in certain embodiments other than the ones outlined in the description above.

The invention is not limited to those diagrams or to the corresponding descriptions. For example, flow need not move through each illustrated box or state, or in exactly the same order as illustrated and described.

Meanings of technical and scientific terms used herein are to be commonly understood as by one of ordinary skill in the art to which the invention belongs, unless otherwise defined.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The foldable collecting apparatus (100) is described above and in the drawings. However, it is understood that it is possible to explain it in other words, based on the explanations above and the drawings. Indeed, the foldable collecting apparatus (100) may be made of one single sheet as explained above and described for example in FIG. 3A.

Figure 10:
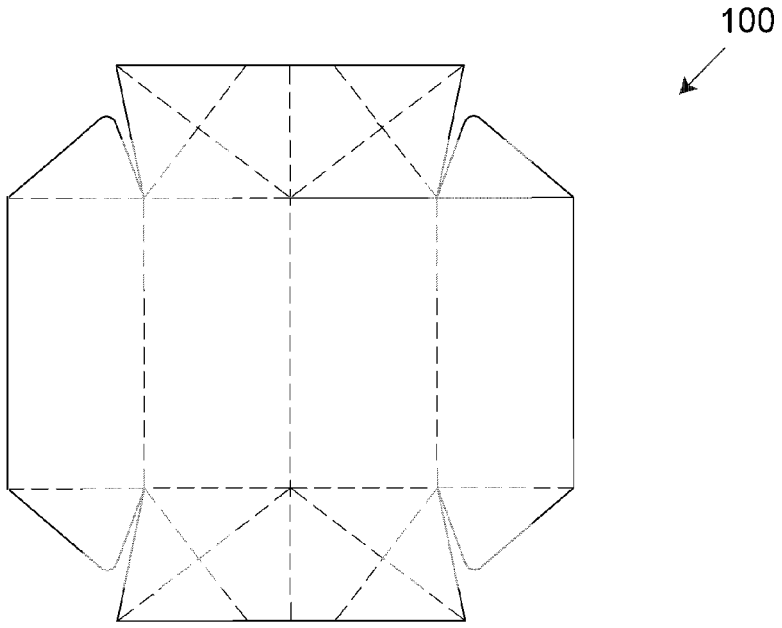
FIG. 10 describes the one single sheet (100).
Figure 11:
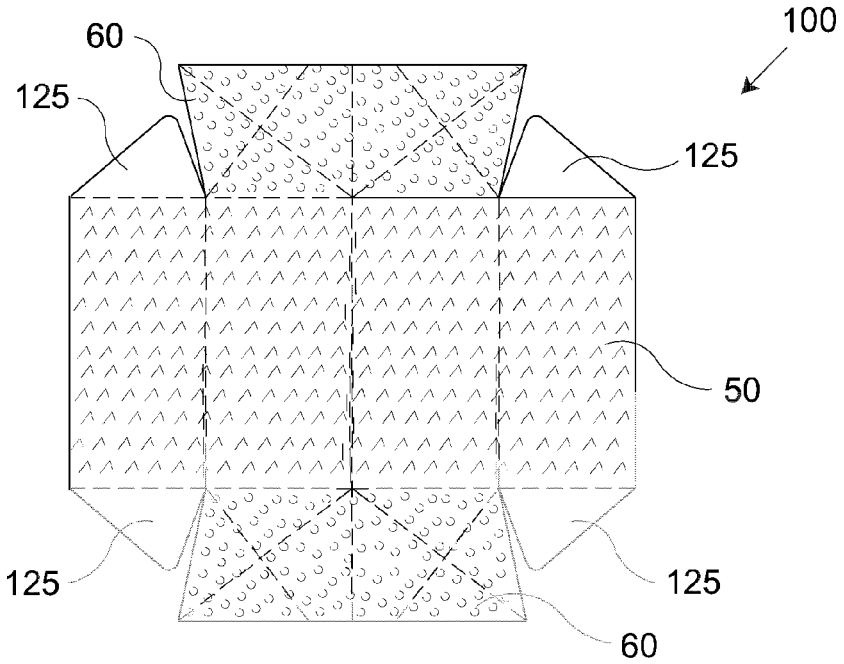
FIG. 11 describes the one single sheet (100) with the one central quadrangle board (50) and two sided panels (60).

The foldable collecting apparatus (100), comprises one single sheet (100) that includes one central quadrangle board (50), four attachment tabs (125) and two sided panels (60) as described for example in FIGS. 10 and 11, which are similar in general to FIG. 3. The one central quadrangle board (50) is divided to two central rectangular panels (51) and two sided rectangular panels (52) as described for example in FIG. 12.

Figure 12:
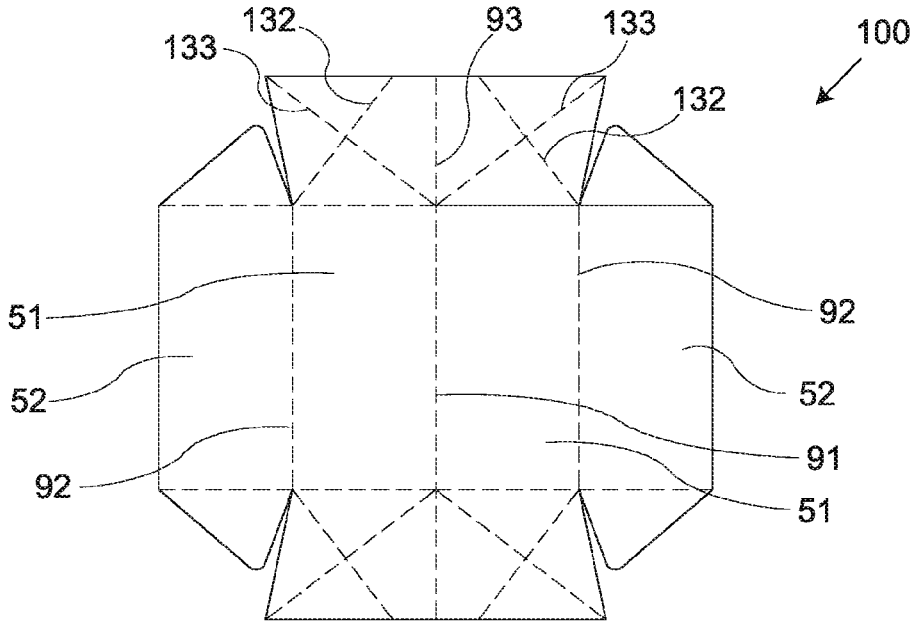
FIG. 12 describes the one single sheet (100) with the locking folding line (133) and the collapsible folding line (132).

The central rectangular panels (51) are connected one to other in parallel along one of their sides by a central folding line (91) and each of said sided rectangular panel (51) is connected in parallel along one of their sides to an adjacent central rectangular panel (51) by a sided folding line (92), as described for example in FIG. 12.

Each of said two sided rectangular panels (52) is connected in its two ends to two of said attachment tabs (125) along a folding line.

Each of said two sided panels (60) includes a divisional folding line (93), two collapsible folding lines (132) and two locking folding lines (133), as described for example in FIGS. 3A and 12. The divisional folding lines (93) are in fact a continuation of the central folding line (91).

Figure 13:
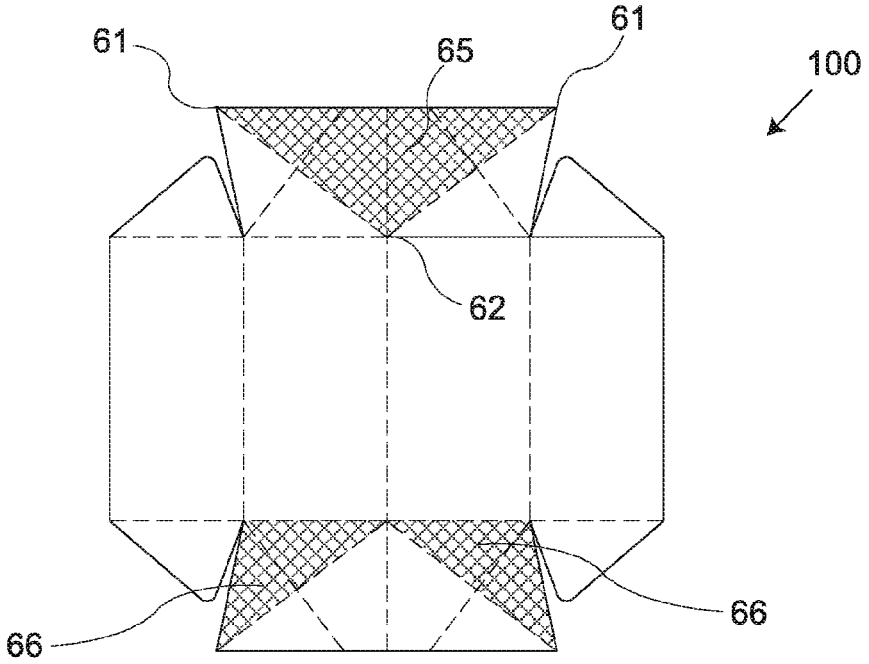
FIG. 13 describes the one single sheet (100) with the locking protruding areas (65) and the separate sided triangle walls (66).

Each of said locking folding line (133) starts from an upper corner (61) of said sided panel (60) and ends in the center of its bottom side (62). Also, each collapsible folding line (132) starts from a bottom corner (63) of said sided panel (60) and ends in the top side of said sided panel (60), as described for example in FIG. 12. The two locking folding lines (133) define a locking protruding area (65) between them and two separate sided triangle walls (66), as described for example in FIG. 13.

Each of said four attachment tabs (125) is attached to the adjacent sided triangle wall (66). The foldable collecting apparatus (100) can be folded into double flat state (71) as described in FIGS. 1A and 1B, to flat state (72) as described for example in FIGS. 1D and 1E, to an open quadrangle box state (73) as described for example in FIG. 1F and to operable state (74) as described for example in FIGS. 2A and 2B.

As to the structure of the apparatus (100), we can explain that when attaching each of said four attachment tabs (125) to the adjacent sided triangle walls (66) then the foldable collecting apparatus (100) turn into open quadrangle box state (73). When said foldable collecting apparatus (100) is in open quadrangle box state (73), it can be turn into said operable state (74) by simultaneously pulling out said locking protruding areas (65) and folding said foldable collecting apparatus (100) along said central folding line (91), as described for example in FIG. 1G.

When said foldable collecting apparatus (100) is in said operable state (74) each of said central rectangular panel with said adjacent sided rectangular panel and with said two adjacent sided triangle walls (66) forming the sub-compartment (140A 140B), which are in fact is in the shape of a triangle-shaped sub-compartment (140A 140B).

When said foldable collecting apparatus (100) is in open quadrangle box state (73), it can be turn into said flat state (72) by pulling inside said locking protruding areas (65) and folding them along said collapsible folding lines (132). When said foldable collecting apparatus (100) is in said flat state (72) it can be turn into said double flat state (71) by folding said foldable collecting apparatus (100) along said central folding line (91).

One of the innovative aspects of the present invention is that the user can hold the apparatus (100) in double flat state (71) in his pocket, due to the small size of the apparatus (100) in this state. When it is necessary, the user can unfold and open the apparatus (100) into the operable state (74) for use. It is understood that the size of the apparatus (100) in operable state (74) should be comfortable for use. The apparatus (100) should be small enough for the hand of the user, and to be big enough to collect and hold the dirt of the pet. So, the general size of the apparatus (100) in operable state (74) is generally already determined by the nature, means, the standard size of a person's hand. The structure of the apparatus (100) enables the user to fold it not only to a flat state but to a double flat state to a small size and to be kept in a pocket for example.

Figure 14:
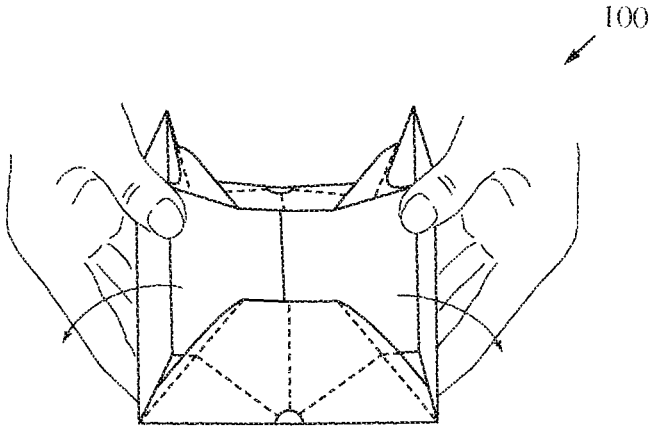
FIGS. 14 until 21 describe the apparatus (100) in process of opening.
Figure 15:
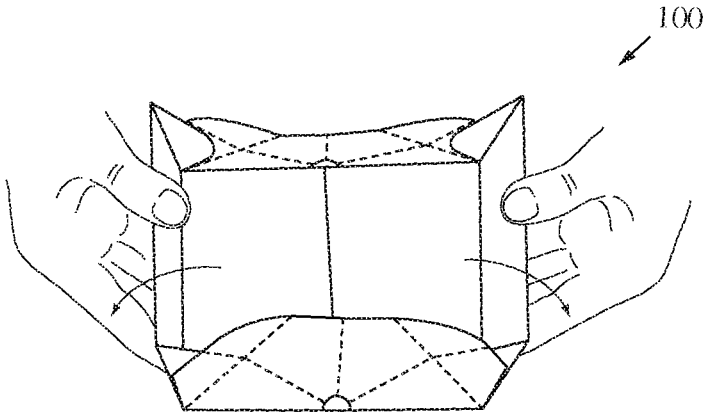
Figure 16:
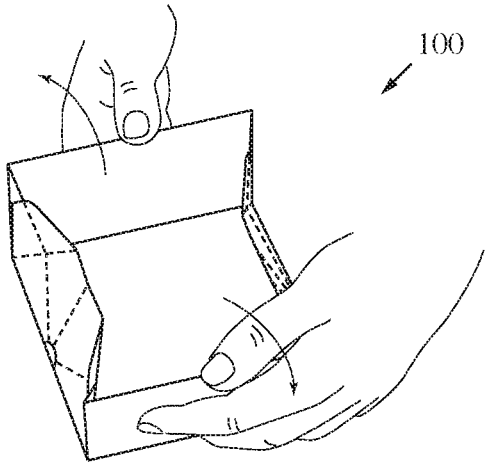
Figure 17:
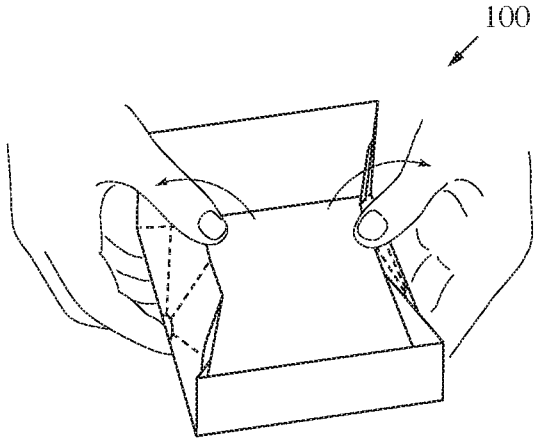
Figure 18:
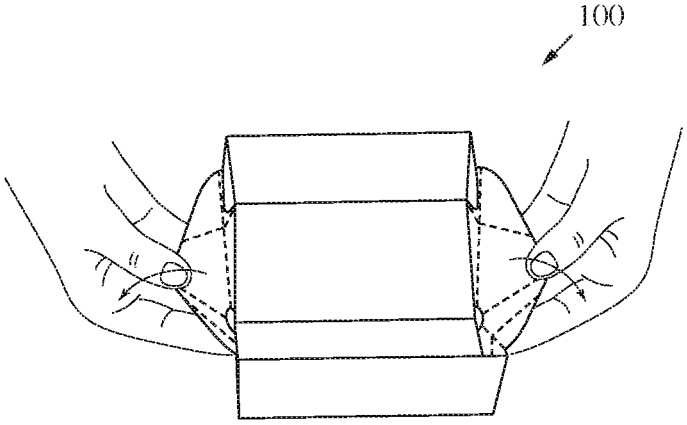
Figure 19:
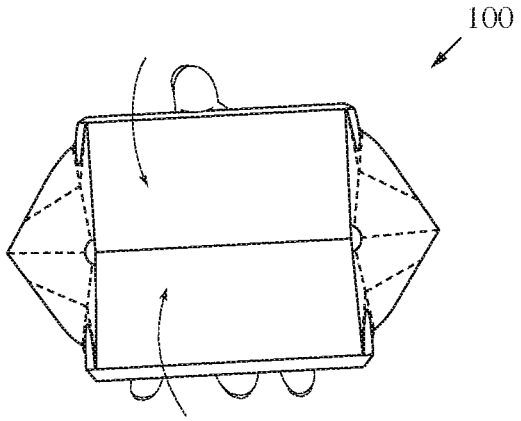
Figure 20:
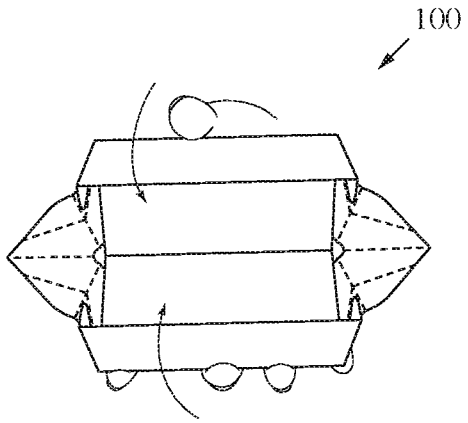
Figure 21:
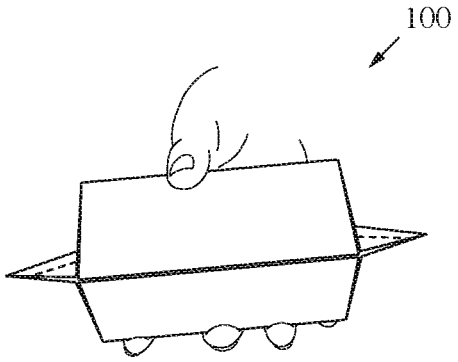

FIGS. 14 until 21 together with FIGS. 1A, 1B, 1C, 1D, 1E, 1F, 1G, 2A and 2B describe the apparatus in process of opening from double flat state (71) into the operable state (74).

What is claimed is:

1. A foldable collecting apparatus, comprises: one single sheet that includes one central quadrangle board, four attachment tabs and two sided panels;

wherein said one central quadrangle board is divided to two central rectangular panels and two sided rectangular panels; wherein said two central rectangular panels are connected one to the other in parallel along one of their sides by a central folding line; wherein each of said sided rectangular panels is connected in parallel along one of their sides to an adjacent central rectangular panel by a sided folding line;

wherein each of said two sided rectangular panels is connected in its two ends to two of said attachment tabs along a folding line;

wherein each of said two sided panels includes a divisional folding line, two collapsible folding lines and two locking folding lines; wherein said divisional folding lines are a continuation of said central folding line; wherein each of said locking folding line starts from an upper corner of said sided panel and ends in the center of its bottom side; wherein each collapsible folding line starts from a bottom corner of said sided panel and ends in the top side of said sided panel; wherein said two locking folding lines define a locking protruding area between them and two separate sided triangle walls;

wherein each of said four attachment tabs is attached to the adjacent sided triangle wall; wherein said foldable collecting apparatus can be folded into double flat state, flat state, open quadrangle box state and operable state;

wherein when attaching each of said four attachment tabs to the adjacent sided triangle walls then the foldable collecting apparatus turn into open quadrangle box state; wherein when said foldable collecting apparatus is in open quadrangle box state, it can be turn into said operable state by simultaneously pulling out said locking protruding areas and folding said foldable collecting apparatus along said central folding line; wherein when said foldable collecting apparatus is in said operable state each of said central rectangular panel with said adjacent sided rectangular panel and with said two adjacent sided triangle walls forming a triangle-shaped sub-compartment; wherein when said foldable collecting apparatus is in open quadrangle box state, it can be turn into said flat state by pulling inside said locking protruding areas and folding them along said collapsible folding lines; whereby when said foldable collecting apparatus is in said flat state it can be turn into said double flat state by folding said foldable collecting apparatus along said central folding line.

* * * * *